US007316773B2

(12) United States Patent
Zhang et al.

(10) Patent No.: US 7,316,773 B2
(45) Date of Patent: Jan. 8, 2008

(54) CATALYTIC CRACKING PROCESS AND THE DEVICE USED THEREIN

(75) Inventors: Jianfang Zhang, Shangdong Province (CN); An Ma, Beijing (CN); Honghong Shan, Shangdong Province (CN); Chaohe Yang, Shangdong Province (CN); Genlin Niu, Shangdong Province (CN); Yongshan Tu, Shangdong Province (CN); Feng Du, Shangdong Province (CN); Yudong Sun, Shangdong Province (CN); Zheng Li, Shangdong Province (CN); Chunyi Li, Shangdong Province (CN); Zhongxiang Han, Shangdong Province (CN)

(73) Assignees: Petrochina Company Limited, Beijing (CN); University of Petroleum China, Dongying, Shangdong Province (CN)

( * ) Notice: Subject to any disclaimer, the term of this patent is extended or adjusted under 35 U.S.C. 154(b) by 317 days.

(21) Appl. No.: 10/800,014

(22) Filed: Mar. 15, 2004

(65) Prior Publication Data

US 2004/0178120 A1 Sep. 16, 2004

(30) Foreign Application Priority Data

Mar. 13, 2003 (CN) ..... 03 1 19441

(51) Int. Cl.
*C10G 51/02* (2006.01)

(52) U.S. Cl. ..... 208/74; 208/73; 208/75; 208/76; 208/77; 208/78; 208/113

(58) Field of Classification Search ..... 208/73, 208/74, 76, 78, 113, 75, 77
See application file for complete search history.

(56) References Cited

U.S. PATENT DOCUMENTS 4,830,728 A * 5/1989 Herbst et al. ..... 208/78
7,029,571 B1 * 4/2006 Bhattacharyya et al. ..... 208/76

* cited by examiner

*Primary Examiner*—Glenn Caldarola
*Assistant Examiner*—Prem C. Singh
(74) *Attorney, Agent, or Firm*—Nixon & Vanderhye P.C.

(57) ABSTRACT

The present invention relates to a catalytic cracking process and a device used in the process in particular, the present invention provides a catalytic cracking process, which comprises which comprises:

1) catalytic cracking a feedstock in the first riser for less than about 1.5 second and sending the resultant stream into the first separating device,;
2) catalytic cracking the recycle oil obtained from the first separating device in the second riser for less than about 1.5 second and sending the resultant stream into the first separating device; and
3) carrying out catalytic reaction of the crude gasoline stream and/or optionally the diesel oil stream obtained from first separating device in the third riser;

wherein the reaction conditions and the catalysts used in the first to third risers are selected according to the requirement for the product of the catalytic cracking process, and the catalyst regeneration and recycle systems are formed respectively for the catalysts used in the first to third risers, so as to effectively improve the product distribution of the catalytic cracking process and the quality of the target product.

4 Claims, 3 Drawing Sheets

CATALYTIC CRACKING PROCESS AND THE DEVICE USED THEREIN

FIELD OF THE INVENTION

The present invention relates to a catalytic cracking process and a device used in the process In particular, the present invention provides a catalytic cracking process comprising using three riser and catalyst regeneration and recycle systems. The reaction conditions and the catalysts used in the first to third risers are selected according to the requirement for the product of the catalytic cracking process, and the catalyst regeneration and recycle systems are formed respectively for the catalysts used the first to third risers, so as to effectively improve the product distribution of the catalytic cracking process and the quality of the target product.

BACKGROUND ARTS

So far, the prior catalytic cracking arts still use the early riser reactor and reaction-regeneration system, wherein a riser reactor and a regenerator make-up a catalyst recycle system. The riser reactors are mostly 30-36 meters high and some of them are even longer than 40 m. The production process is that in the riser reaction-regeneration system, preheated feedstock enters a riser reactor through the feed nozzle and comes into contact with the high-temperature catalyst coming from a regenerator, vaporizes, and reacts. The catalyst-carrying oil-vapor flows along the riser upwards at an average linear velocity of about 10 mls it reacts while it flows and the reaction takes about 3 seconds. During the reaction procedure, coke generates and deposits on the surface and the active center of the catalyst so that the activity and selectivity of the catalyst drop rapidly. For this reason, the coked catalyst must separate from the oil-vapor in time and enter a regenerator for regeneration and recycle application, thus forming a circuit of the catalyst. The oil-vapor enters a distillation system to separate into products (generally including three products, i.e. catalytic diesel oil, gasoline, and liquefied petroleum gas). Part of the feed oil, which does not convert into light products after once reaction (generally called recycle oil), enters the riser reactor again to carry out reaction. This is the basic process of the catalytic cracking reaction-regeneration system.

Due to the especial characters of heavy oil, varieties of difficulties are brought into the catalytic cracking process. In recent years, the development of the catalytic cracking technology has been focused mainly on the residue fluid catalytic cracking (RFCC) technology. In the prior art, revamps have been made mostly on local parts before or after the riser reactor to achieve certain positive effects. The following are some examples of the main new technologies and their functions:

An atomization technology of heavy feed (nozzle), which improves the contact state between a feedstock and a catalyst to enhance the yield of light oil.

A gas-solid rapid separation technology at the end of the riser to separate the gas-solid quickly and thus reduce the over cracking reaction.

A riser reaction termination agent technology, which shortens the reaction time, reduce the harmful secondary reactions and enhances the yield of light oil.

A high-efficiency multi-stage stripping technology of the spent catalyst, which enhances stripping effects, reduces the yield of coke and increases the yield of light oil.

A two-stage high-efficiency regeneration technology, which enhances the burning of coke, reduces the coke content of the regenerated catalyst and maintains high activity of the catalyst.

A multi-position feeding technology, which treats feedstocks with different characters in different ways and optimizes the reaction process.

A new millisecond catalytic cracking technology, which shortens the reaction time and decreases the secondary reaction.

A descending riser technology for improving the mechanism of the oil/catalyst contact reaction, which is now still in an R & D phase.

All the above prior catalytic cracking arts do not change the general structure of the current riser reactor except the last two which involve a change in the form of the riser reactor. However, the current riser catalytic cracking processes have many disadvantages: (1) Too long a riser leads to an overlong residence time of the oil-vapor in the riser (about 3 seconds), but the catalyst maintains its effective activity and selectivity for only a shorter time (about less than 1 second). Therefore, the improvement of the product distribution and the enhancement of the conversion depth are unfavorable due to the occurrence of lots of thermal reactions and detrimental secondary reactions in the second half of the conventional riser, (2) In the conventional catalytic cracking, the fresh feedstock and recycle oil (recycle oil and oil slurry) react in a same riser. This is very detrimental because the vaporizing character of the two oils are different and their ability to adsorb and react on the catalyst is opposite. The result of competition is that an full and effective reaction can not be achieved, thereby the enhancement of the yield of the light product and the conversion depth are affected (this has been proved by the industrial test on the two-stage riser catalytic cracking technology developed previously by the inventors of the present invention, (3) The content of olefins in the conventional cracked gasoline fraction is high (especially in the cracking of heavy oil) because the activity of the catalyst is very low when a great amount of gasoline is produced, and therefore the olefins in gasoline can not carry out an effective conversion.

The patent submitted by the applicants of the present invention, U.S.20020108887 A1, "Two-stage riser catalytic cracking process" comprises first introducing the high temperature catalyst coming from the regenerator into the lower part of the first riser to contact a feed oil, which vaporizes and reacts, and separating the partly deactivated half-spent catalyst between the two stages after 1 second for regeneration and recycle, providing the regenerated catalyst to the second riser, which comes into contact with the oil-vapor coming from the intermediate separator, said oil-vapor flowing upwards together with the catalyst and continuing the catalytic cracking reaction. Although this process nay improve the distribution and quality of the product, the catalytic cracking reaction of the three streams, fresh feedstock, recycle oil, and cracked oil restricts each other because they need different reaction conditions. Besides, the catalyst needed for cracking heavy oil to produce light oil is completely different from that needed for further cracking gasoline to produce low olefins. Therefore, this process can not achieve different production aims in the catalytic cracking process to produce light oil, or enhance the selectivity of gasoline cracking to ethylene-propylene, or enhance the yield of propylene.

SUMMARY OF THE INVENTION

The objective of the present invention is to avoid the shortcomings of the above prior arts by providing a catalytic cracking process, which comprises:

1) catalytic cracking a feedstock in the first riser for less than about 1.5 second and sending the resultant stream into the first separating device;

2) catalytic cracking the recycle oil obtained from the first separating device in the second riser for less than about 1.5 second and sending the resultant stream into the first separating device, and 3) carrying out catalytic reaction of the crude gasoline stream and/or optionally the diesel oil stream obtained from first separating device in the third riser;

wherein the reaction conditions and the catalysts used in the first to third risers are selected according to the requirement for the product of the catalytic cracking process, and the catalyst regeneration and recycle systems are formed respectively for the catalysts used in the first to third risers, so as to effectively improve the product distribution of the catalytic cracking process and the quality of the target product.

The present invention also provides a catalytic cracking reaction device used in said process, which comprises:

The first catalyst regeneration and recycle system comprising the first riser, the first settler, a catalyst regenerator and a catalyst transfer conduit;

The first separating device for separating the oil-vapor obtained in the first settler, the conduit connecting the first settler to the first separator, the conduit introducing the recycle oil in the first separator into the second riser, and the conduit introducing the crude gasoline and/or diesel oil in the first separator into the third riser, The second catalyst regeneration and recycle system comprising the second riser, the first settler, a catalyst regenerator, and a catalyst transfer conduit, the reaction mixture in the first and second risers being introduced into the first separator via the same settler; and The third catalyst regeneration and recycle system comprising the third riser, the second settler, a catalyst regenerator and a catalyst transfer conduit, and the second separator separating the oil-vapor obtained in this settler.

No matter what catalyst is used, the first and second catalyst recycle systems share a same settler, while they may share a same generator, or use respective generator according to different requirements of the process. Thus, combining the three risers and three catalyst regeneration and recycle systems, different reaction conditions and catalysts respectively suitable for different streams in steps 1 to 3 are adopted to effectively improve the distribution and quality of the product in the catalytic cracking process. The major characters of this technology are:

1The original structural form of the riser reactor and the flow of reaction-regeneration system are completely broken, and the single riser reactor used in the field of the current catalytic cracking technology is replaced by a combination reactor of three riser and three catalyst regeneration and recycle systems so that the streams with different characters may use respective conditions and catalyst suitable for them to conduct reaction.

2. The present invention also comprises the use of catalysts with different performances The catalysts used in the first and second risers include commercial catalytic cracking catalysts of various brands. The catalysts used in the third riser include one or more catalysts selected from the group consisting of conventional cracking catalysts, the catalysts and promoters producing more ethylene-propylene, the catalysts and promoters reducing the production of olefins, and desulphurization catalysts and promoters.

3. According to different production objectives, the purpose of the present invention may be achieved by using different forms of FCC process flows of three riser and three catalyst regeneration and recycle systems, In case of using the same catalyst in steps 1) to 3), a single regenerator may be used, while in case of using different catalysts in steps 1) to 3), two or more regenerators may be used respectively (including installation of two isolated regeneration zone in one regenerator). One, two, or more catalysts with different performances may be used in each catalyst regeneration and recycle system.

DESCRIPTION OF THE DRAWINGS

FIG. 3 is the schematic process flow chart of the third form of the combined catalytic cracking device of three risers and three catalyst regeneration and recycle systems, wherein the first and second catalyst regeneration and recycle systems use a same catalyst, but the third catalyst regeneration and recycle system uses another catalyst, and the third riser is a descending reactor, Wherein.

Figure 1:
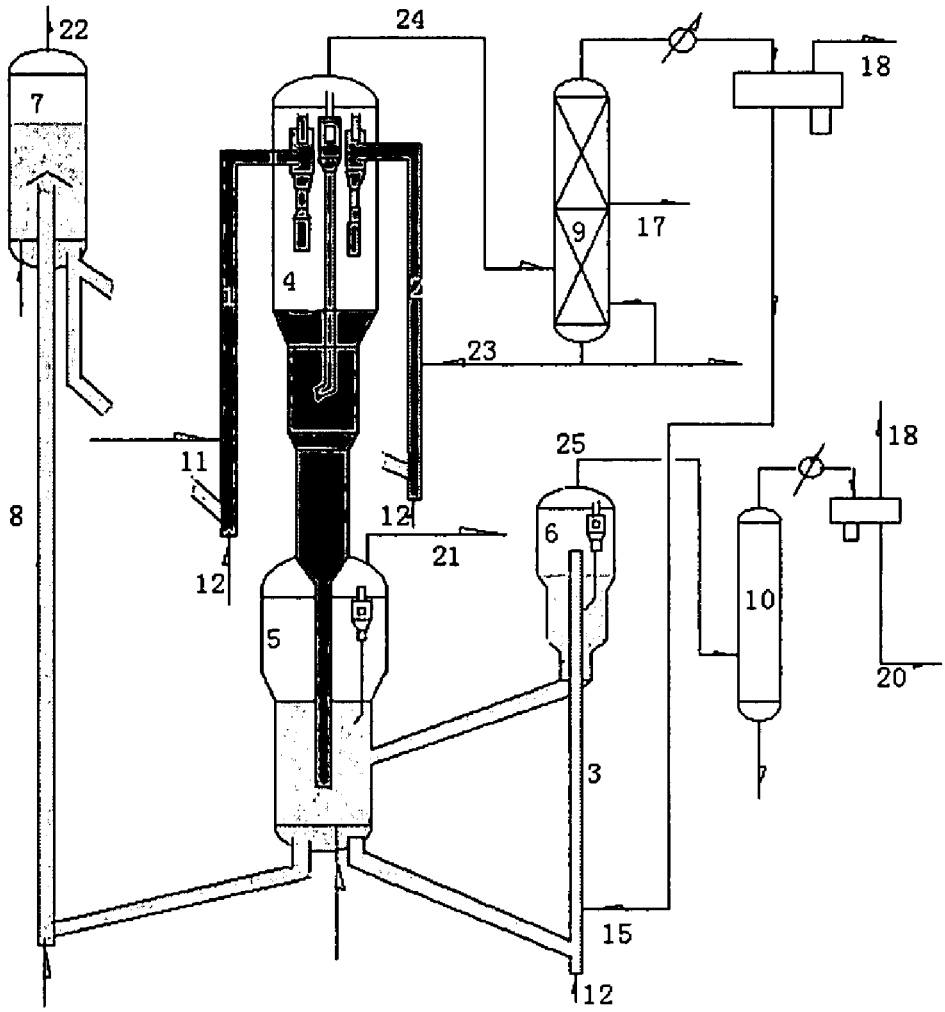
FIG. 1 is the schematic process flow chart of the first form of the combined catalytic cracking device of three risers and three catalyst regeneration and recycle systems, wherein three riser and three catalyst regeneration and recycle systems use a same catalyst.

1—first riser, 2—second riser, 3—third riser, 4—first settler, 5—first regenerator, 6—second settler, 7—catalyst buffer tank, 8—transfer and coke burning conduit of the catalyst, 9—fractionation tower, 10—stripping tower, 11—feed oil inlet, 12—pre-lifting gas, 13—air-+-dry gas, 14—pre-lifting gas, 15—recycle crude gasoline inlet, 16—$C_4^+$ olefin reprocessing, 17—diesel oil out of device, 18—rich gas to absorptive stabilization and separation, 19—cracked gas to absorptive stabilization and separation, 20—high octane gasoline, 21—flue gas, 22—flue gas, 23—inlet of recycle oil and oil slurry, 24—conduit of the first settler stream to fractionation tower.

DETAILED DESCRIPTION OF THE INVENTION

In order to realize the above objective, the present invention prefers the following three embodiments of the device to realize the objective of the present invention:

1. When three catalyst regeneration and recycle systems use a same catalyst, the first riser 1 and second riser 2 may share the first settler 4, and the first, second, and third risers may share the first regenerator 5. Thus, the tops of the first riser 1 and second riser 2 may be directly equipped in the first settler 4, and their bottoms are respectively connected with the buffer tank 7. The top of the third riser 3 is equipped in the third settler 6, and its bottom is connected with the first regenerator 5.

2. When the first and second regeneration and recycle systems use a same catalyst and the third catalyst regeneration and recycle system uses another catalyst, the first riser 1 and second riser 2 may share the first settler 4, and the first, second risers may share the first regenerator 5, but baffle may be equipped in the first regenerator 5 to isolate independent regeneration spaces for the use of the third catalyst regeneration and recycle system. Thus, the tops of the first riser 1 and second riser 2 are directly equipped in the first settler 4, and their bottoms are respectively connected with the buffer tank 7.The top of the third riser 3 is equipped in the second settler 6, and its bottom is connected with the independent regeneration space of the first regenerator 5.

3. When the first and second regeneration and recycle systems use a same catalyst and the third catalyst regeneration and recycle system uses another catalyst, the first riser 1 and second riser 2 may share the first settler 4, and the first, second risers may share the first regenerator 5, Thus, the tops of the first riser 1 and second riser 2 may be directly equipped in the first settler 4, and their bottoms are respectively connected with the first regenerator 5. The third riser 3 is a descending reactor, the outlet of which is equipped in the second settler 6 and the inlet is connected with catalyst buffer tank 7.

According to different requirements for the product, the present invention prefers the following three embodiments to realize the objective of the present invention:

The first embodiment is to produce more gasoline and diesel oil with heavy oil as the feedstock, and simultaneously realize effective upgrading of catalytic gasoline.

A fresh feedstock reacts in the first riser 1 by using a catalytic cracking catalyst, high catalyst/oil ratio, and a short contact time. The reaction product of the first riser enters fractionation tower 9 via conduit 24 for separation, and diesel oil 17 is withdrawn for the device as a final product. Recycle oil and oil slurry 23 enter the second riser 2 and react under adequate reaction conditions and the product thereof also enters fractionation tower 9 via conduit 24.Crude gasoline 15 coming from fractionation tower 9 enters the third riser 3, wherein one or more catalysts selected from the group consisting of conventional cracking catalysts, olefin-reducing catalysts, desulphurization catalysts, or other multifunctional catalysts, etc. may be used for reaction. The oil-vapor after reaction enters stripping tower 10 via conduit 25 to separate a small amount of condensation product (light diesel oil fraction), yielding clean gasoline 20 which meets the requirement for the olefin content, sulfur content, and octane rate.

The second embodiment is to produce more low olefins and high-octane gasoline with heavy oil as the feedstock.

The reaction conditions in the first and second risers are controlled to enhance the severity, and produce as much as possible gasoline and gas, and as little as possible diesel oil (diesel oil may be reprocessed if necessary). Crude gasoline 15 coming from fractionation tower 9 enters the third riser 3, wherein reaction proceeds under adequate conditions by using a catalyst producing more ethylene-propylene, yielding a gas rich in etliylene-propylene and high-octane gasoline. The present embodiment may achieve the objective of producing more diesel oil and low olefins.

EXAMPLE 1

The objective is to enhance the conversion depth and the yield of light oil, and improve the product quality.

Referring to FIG. 1, the reaction flow is:

The high temperature catalyst coming from regenerator 5 is first lifted to the catalyst buffer tank 7 by air. During the lifting procedure, a small amount of residual coke may be burned off in transfer conduit 8 and buffer tank 7.The high temperature catalyst then enters the lower part of the first riser 1 and contacts fresh feed oil 11, which vaporizes and reacts. After about 1 second, the resultant stream enters the first settler 4 to separate the catalyst (called half-spent catalyst) from oil-vapor, and the half-spent catalyst returns to the regenerator 5 for regeneration after separating the carried oil-vapor via the stripping section of settler 4, thereby forming the first catalyst regeneration and recycle system. The oil-vapor coming from the first settler 4 enters fractionation tower 9 for separation. The recycle oil and oil slurry coming from the bottom of fractionation tower 9 enter the second riser 2 via conduit 23 and contact the hot catalyst coming from buffer tank 7 and react After about 1 second, the resultant stream enters the first settler for oil/catalyst separation, and the obtained catalyst also returns to the regenerator 5 after stripping, thereby forming the second catalyst regeneration and recycle system. The diesel oil is withdrawn from fractionation tower 9 as a product. The oil-vapor coming from the top of fractionation tower 9 is separated into crude gasoline 15 and catalytic rich gas 18 via condensation-cooling. The rich gas is introduced into the absorptive stabilization system, and the crude gasoline 15 enters the third riser 3 and comes into contact with the catalyst coming from regenerator 5 (or external heat exchanger of the regenerator) and reacts. After 1-5 second, the resultant stream enters the second settler 6 to conduct oil/catalyst separation and the catalyst on which a small amount of coke deposits returns to regenerator 5 after stripping, thereby forming the third catalyst regeneration and recycle system. The oil-vapor coming from the top of the second settler 6 still containing very little diesel oil enters stripping tower 10. Diesel oil separates from the bottom of tower 10 and the top oil-vapor separates into gasoline 20 having high-octane rate and low content of olefins and cracked gas, which separately enter the absorptive stabilization system for post-treatment.

It is seen from the reaction result that the catalytic cracking device of the present invention in FIG. 1 overcomes the disadvantage of the two-stage riser process that gasoline, recycle oil and oil slurry proceed reaction together in the second riser reactor as described in US 20020108887 A1. The fresh feedstock enters the first riser, the recycle oil enters the second riser, and the crude gasoline enters the third riser, realizing the sectionalized reaction principle that different reaction conditions are used for streams with different properties. By controlling the reaction conditions in the third riser, not only the loss of gasoline in cracking may be reduced, but also the effect of reducing the content of olefins in gasoline may be improved, thereby more ideal yield and quality of the product than the two-stage riser technology may be achieved. The comparative results are shown in Table 1.

TABLE 1

A comparison between the yield of the catalytic cracked product in a three riser and three catalyst regeneration and recycle systems and a two-stage riser system. (Scheme for producing more gasoline)

| | Two-stage riser system | Three riser and three catalyst regeneration and recycle systems |
|---|---|---|
| First riser temperature, ° C. | 500 | 500 |
| First riser time, second | 1.2 | 1.2 |
| First riser catalyst/oil ratio | 6.0 | 6.0 |
| Second riser temperature, ° C. | 505 | 510 |
| Second riser time, second | 1.2 | 1.2 |

TABLE 1-continued

A comparison between the yield of the catalytic cracked product in a three riser and three catalyst regeneration and recycle systems and a two-stage riser system. (Scheme for producing more gasoline)

| | Two-stage riser system | Three riser and three catalyst regeneration and recycle systems |
|---|---|---|
| Second riser catalyst/oil ratio | 5.5 | 6.0 |
| Third riser temperature, ° C. | | 480 |
| Third riser time, second | | 2.0 |
| Third riser catalyst/oil ratio | | 5.0 |
| Dry gas + loss, m % | 3.63 | 3.20 |
| LPG, m % | 13.33 | 11.40 |
| Gasoline, m % | 38.09 | 40.65 |
| Diesel oil, m % | 34.44 | 34.80 |
| Oil slurry, m % | 1.63 | 1.65 |
| Coke burned, m % | 8.88 | 8.50 |
| Sum, m % | 100.00 | 100 |
| Diesel oil/gasoline ratio | 0.90 | 0.86 |
| Total conversion, m % | 63.93 | 63.75 |
| Yield of light oil, m % | 72.53 | 75.45 |
| Yield of target product, m % | 85.86 | 86.85 |
| Yield of total liquid, m % | 87.49 | 88.50 |
| Olefin content in Gasoline, v % | 33.6 | 30.0 |
| RON of gasoline | 89.4 | 90.5 |

Note.
The same feedstock and catalyst are used for the two processes (the feedstock is the feedstock for the catalytic cracking device of Shenghua Teaching Experimental Plant of Petroleum University, Shangdong, China and the catalyst is ZC-7300 balance catalyst from ZhouChun Catalyst Factory, Shandong, China.

The data in Table 1 shows that compared with the two-stage riser system, the catalytic cracking system of the present invention achieves 2% higher yield of the light oil, 1% higher yield of the target product and total liquid, and lower yield of the dry gas and coke. This mainly owes to the moderate reaction conditions used in the third riser which reduce the loss of gasoline in cracking. Besides, the moderate reaction conditions in the third riser promote hydrogen transfer and isomerization reactions of gasoline, thereby further reducing the olefin content in gasoline.

EXAMPLE 2

Figure 2:
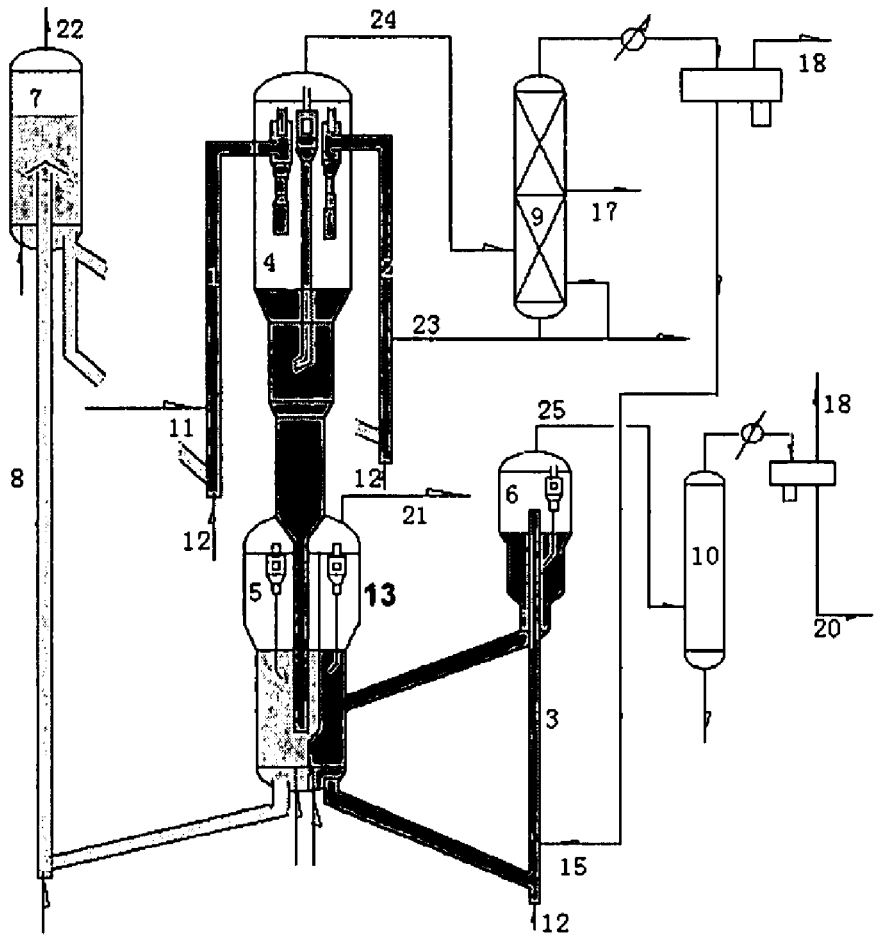
FIG. 2 is the schematic process flow chart of the second form of the combined catalytic cracking device of three risers and three catalyst regeneration and recycle systems, wherein the first and second catalyst regeneration and recycle systems use a same catalyst, but the third catalyst regeneration and recycle system uses another catalyst.

Tile objective is to enhance the conversion depth and yield of gasoline, improve the quality of the product, or produce low olefins Referring to FIG. 2, two catalysts with different characters are used in this example because the catalyst used in the upgrading of crude gasoline or cracking of crude gasoline to produce low olefins is different from the catalyst used in the cracking of heavy oil. The first and second catalyst regeneration and recycle systems use the ZC-7300 balance catalyst, from ZhouChun Catalyst Factory, Shandong, China, taken from the catalytic cracking device of Shenghua Teaching Experimental Plant of Petroleum University, Shandon, China, while the third catalyst regeneration and recycle system uses the CRP-1 balance catalyst producing more olefins, from ZhouChun Catalyst Factory, Shandong, China, taken from the heavy oil catalytic cracking device of Jinan refinery, Shandong, China. The reaction flow is.

The high temperature catalyst coming from the first regenerator 5 is first lifted to catalyst buffer tank 7 with air. During the lifting procedure, a small amount of residual coke on the catalyst may be burned off in transfer conduit 8 and buffer tank 7. The high temperature catalyst then enters the lower part of the first riser 1 and contacts fresh feed oil 11, which vaporizes and reacts. After about 1 second, the resultant stream enters the first settler 4 to separate the obtained half-spent catalyst from oil-vapor, and the half-spent catalyst returns to the first regenerator 5 for regeneration after separating the carried oil-vapor via the stripping section of settler 4, thereby forming the first catalyst regeneration and recycle system. The oil-vapor coming from the first settler 4 enters fractionation tower 9 for separation. The recycle oil and oil slurry coming from the bottom of fractionation tower 9 enter the second riser 2 via conduit 23 and contact the hot catalyst coming from the buffer tank 7 and react. After about 1 second, the resultant stream enters the first settler 4 for oil/catalyst separation, and the obtained catalyst also returns to the first regenerator 5 after stripping, thereby forming the second catalyst regeneration and recycle system. Diesel oil 17 is withdrawn from fractionation tower 9 as a product. The oil-vapor coming from the top of fractionation tower 9 is separated into crude gasoline 15 and catalytic rich gas 18 via condensation-cooling. The rich gas is introduced into the absorptive stabilization system, and crude gasoline 15 enters the third riser 3 and comes into contact with another catalyst coming from the independent regeneration zone of regenerator 5 isolated by baffle, and reacts. After 1-5 second, the resultant stream enters the second settler 6 to conduct oil/catalyst separation and the catalyst on which a small amount of coke deposits returns to the independent regeneration zone of the first regenerator 5, thereby forming the third catalyst regeneration and recycle system The oil-vapor coming from the top of the second settler 6 still containing very little diesel oil enters stripping tower 10.Diesel oil separates from the bottom of tower 10, and the top oil-vapor separates into gasoline having high-octane rate and low content of olefins, and cracked gas via condensation-cooling, which separately enter the absorptive stabilization system for post-treatment. The comparative results are shown in Table 2.

TABLE 2

Comparison of the product yield in the scheme for producing more ethylene-propylene

| Catalyst<br>Feedstock: Daqing residue | CRP-1 balance catalyst Two-stage riser technology | CRP-1 balance catalyst Three-riser system |
|---|---|---|
| Operating conditions | | |
| First riser temperature, ° C. | 580 | 580 |
| First riser catalyst/oil ratio | 7.48 | 7.5 |
| First riser time, second | 1.57 | 1.3 |
| Second riser temperature, ° C. | 600 | 600 |
| Second riser catalyst/oil ratio | 7.25 | 8.5 |
| Second riser time, second | 0.55 | 1.3 |
| Third riser temperature, ° C. | | 600 |
| Third riser catalyst/oil ratio | | 7.5 |
| Third riser time, second | | 1.0 |
| Water/oil ratio | 20/44 | 20/30/20 |
| Product distribution, wt % | | |
| Hydrogen | 0.27 | 0.35 |
| Dry gas | 15.33 | 13.65 |
| LPG | 41.82 | 47.5 |
| Gasoline | 23.91 | 20.0 |
| Diesel oil | 7.65 | 7.0 |
| Heavy oil | 2.91 | 3.0 |
| coke | 8.39 | 8.5 |
| Hydrogen + methane + ethane, wt % | 7.37 | 7.5 |

TABLE 2-continued

Comparison of the product yield in the scheme for producing more ethylene-propylene

| Catalyst<br>Feedstock: Daqing residue | CRP-1 balance catalyst Two-stage riser technology | CRP-1 balance catalyst Three-riser system |
|---|---|---|
| Light oil yield, wt % | 31.55 | 27.0 |
| Total liquid yield, wt % | 73.37 | 74.5 |
| Ethylene, wt % | 8.23 | 11.0 |
| Propylene, wt % | 21.76 | 31.0 |
| Butene, wt % | 16.88 | 9.5 |
| Propylene + ethylene, wt % | 29.99 | 42.0 |
| Total three olefins, wt % | 46.87 | 51.5 |
| Gasoline property | | |
| Olefins | 45.4 | 9.5 |
| Aromatics | 39.47 | 73.5 |
| Cyclanes | 2.22 | 2.5 |
| Isoparaffins | 9.99 | 10.5 |
| Normal paraffins | 3.38 | 4.0 |

Table 2 shows the data on the product distribution in the two-stage riser system and the scheme of the catalytic cracking reaction system of the present invention for producing more ethylene-propylene. It is seen from the data that the catalytic cracking reaction system of the present invention has an obvious dominance. The yield of ethylene+ propylene is up to 42% when Daqing reduced crude is used as the feedstock. This is unachievable with any other technologies.

EXAMPLE 3

The objective is to effectively produce more low olefins and high-octane gasoline.

Figure 3:
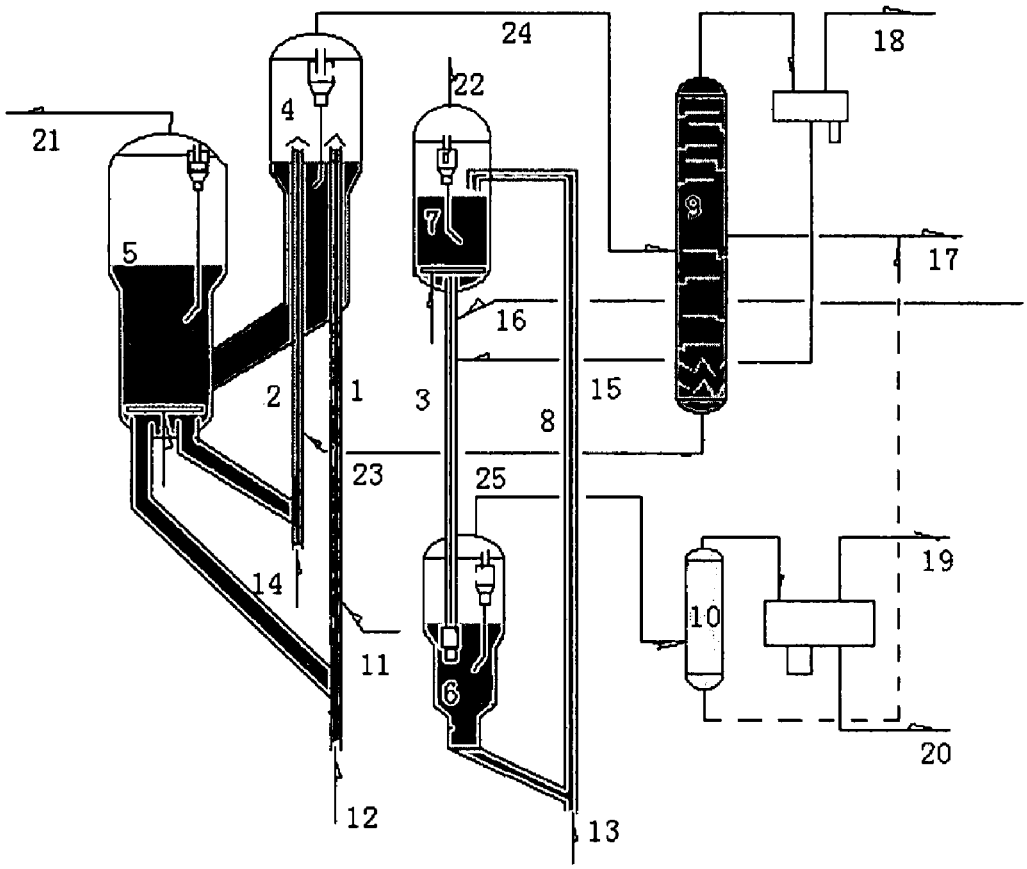

Referring, to FIG. 3, the difference from Example 2 is that the third riser in Example 3 adopts a descending riser reactor and the reprocessing of $C_4$ olefins is taken into account, thereby the yield of low olefins is effectively enhanced. The reaction flow is:

The high temperature catalyst coming from the first regenerator 5 enters the lower part of the first riser 1 and contacts fresh feed oil 11, which vaporizes and reacts. After about 1 second, the resultant stream enters the first settler 4 to separate the catalyst (called half-spent catalyst) from oil-vapor and the half-spent catalyst returns to the first regenerator 5 for regeneration after separating the carried oil-vapor via the stripping section of settler 4, thereby forming the first catalyst regeneration and recycle system The oil-vapor enters fractionation tower 9 for separation. The recycle oil and oil slurry coming from the bottom of the fractionation tower enter the second riser 2 via conduit 23 and come into contact with the regenerated catalyst coming from the first regenerator 5, and reacts After about 1 second, the resultant stream enters the first settler 4 for oil/catalyst separation, and the obtained catalyst also returns to the first regenerator 5 after stripping, thereby forming the second catalyst regeneration and recycle system. Diesel oil 17 is withdrawn from fractionation tower 9 as a product. The oil-vapor coming from the top of the fractionation tower 9 is separated into crude gasoline 15 and catalytic rich gas 18 via condensation-cooling. The rich gas is introduced into the absorptive stabilization system, and the crude gasoline enters the third descending riser 3 and comes into contact with the high temperature catalyst coming from the catalyst buffer tank 7 (another catalyst for producing low olefins taken from the heavy oil catalytic cracking device of Jinan Refinery, Shandon-, China, CRP-1 balance catalyst with different characters, ZhouChun Catalyst Factory, Shandong, China, and reacts. After about half a second, the resultant stream enters the second settler 6 for oil/catalyst separation. The catalyst on which a small amount of coke deposits enters the catalyst transfer and coke burning conduit 8 and returns to catalyst buffer tank 7 after regeneration, thereby forming the third catalyst regeneration and recycle system. The oil-vapor coming from the top of the second settler 6 contains a great amount of ethylene, propylene and high-octane gasoline, as well as a mall amount of diesel oil. These vapors enter stripping tower 10. The diesel oil separates from the bottom of tower 10, and the top oil-vapor separates into high-octane gasoline and cracked gas via condensation-cooling, which enter the absorptive stabilization and gas separation system for post-treatment. C.sub.4.sup.+, olefins 16 obtained in the gas separation system return to the third riser 3, comes into contact with the high temperature catalyst coming from the catalyst buffer tank 7, and reacts.

Examples 2 and 3 also use three-riser and three catalyst regeneration and recycle systems constituted by addition of a third riser and second settler on the basis of the two-stage riser system. The reaction conditions in the first and second risers are controlled to enhance the severity and produce as much as possible gasoline and gas, and as little as possible diesel (diesel is reprocessed if necessary). A gas rich in ethylene-propylene and a high-octane gasoline are finally obtained by introducing gasoline into the third riser, using a catalyst producing more ethylene-propylene, carrying out the reaction under adequate conditions, reprocessing the $C_4$ fraction.

EFFECT OF THE INVENTION

Compared with prior arts, the present invention has the following outstanding characters:

1. Enhancing and improving the catalytic cracking reaction process ability to largely enhance the conversion depth, obtain an optimum product distribution at a high conversation, and enhance the yield of light oil; obviously improve the quality of the catalytic gasoline; largely lower the content of olefins in the catalytic gasoline, increase the content of isoparaffins, and raise the octane rate of gasoline.

2. About 40% of the yield of ethylene-propylene and a part of high-octane gasoline may be obtained by using heavy oil as a feedstock, using the catalytic cracking reaction system of the present invention and a new ethylene-propylene catalyst.

We claim:

1. A catalytic cracking process, which comprises:

1) catalytic cracking a feedstock in a first riser for less than about 1.5 second and sending a resultant stream into a first separating device;

2) catalytic cracking a recycle oil obtained from the first separating device in a second riser for less than about 1.5 second and sending a resultant stream into the first separating device; and 3) carrying out catalytic reaction of a crude gasoline stream and/or optionally a diesel oil stream obtained from the first separating device in a descending third riser;

wherein the reaction conditions and the catalysts used in the first to third risers are selected according to the requirement for the product of the catalytic cracking process, and the catalyst regeneration and recycle systems are formed respectively for the catalysts used in the first to third risers, wherein a high temperature catalyst coming from a first regenerator (5) enters the lower part of the first riser (1) and contacts a feed oil, which vaporizes and reacts; after about 1 second, the resultant stream entering a first settler (4) to separate the coked catalyst from oil-vapor, and the coked catalyst returns to the first regenerator (5) for regeneration, thereby forming a first catalyst regeneration and recycle system;

said oil-vapor enters the first separating device, said first separating device being a fractionation tower (9), for separation; wherein recycle oil and oil slurry coming from the bottom of the fractionation tower (9) enter the second riser (2) and contacts with the catalyst coming from the first regenerator (5) and reacts; after about 1 second, the resultant stream entering a first settler (4) for oil/catalyst separation, and the obtained catalyst also returning to the first regenerator (5), thereby forming a second catalyst regeneration and recycle system;

said oil-vapor coming from the top of the fractionation tower (9) being separated into crude gasoline (15) and catalytic rich gas (18); the crude gasoline entering the descending third riser (3) and contacting with another high temperature catalyst coming from a catalyst buffer tank (7) and reacting; after about half a second, the resultant stream entering a second settler (6) to conduct oil/catalyst separation; the obtained catalyst entering a catalyst transfer and coke burning conduit (8) and returning to catalyst buffer tank (7) after regeneration, thereby forming a third catalyst regeneration and recycle system;

wherein oil-vapor coming from the top of the second settler enters a stripping tower (10); the resultant top oil-vapor being separated into high-octane gasoline and cracked gas, the cracked gas entering an absorptive stabilization and gas separation system; wherein C4+olefins (16) obtained in the gas separation system return to the third riser (3), which contacts with the high temperature catalyst coming from catalyst buffer tank (7) and reacts.

2. The catalytic cracking process said in claim 1, wherein different catalysts are used in the first to third risers.

3. The catalytic cracking process according to claim 1, wherein a same catalyst is used in the first to third risers, said catalyst being a catalytic cracking catalyst.

4. The catalytic cracking process according to claim 1, wherein a same catalyst is used in the first and the second risers, and said catalyst being a catalytic cracking catalyst, while another catalyst is used in the third riser, and said catalyst being one or more catalysts selected from the group consisting of conventional cracking catalysts, catalysts and promoters producing more ethylene-propylene, catalysts and promoters reducing the production of olefins, and desulphurization catalysts and promoters.

* * * * *